US011384537B2

(12) United States Patent
Marc-Aurele

(10) Patent No.: US 11,384,537 B2
(45) Date of Patent: Jul. 12, 2022

(54) SUSPENDED CEILING SYSTEM INCORPORATING KEY AND KEYHOLE COMBINATIONS AND METHOD OF INSTALLING SAME

(71) Applicant: Andre Marc-Aurele, Pont-Rouge (CA)

(72) Inventor: Andre Marc-Aurele, Pont-Rouge (CA)

( * ) Notice: Subject to any disclaimer, the term of this patent is extended or adjusted under 35 U.S.C. 154(b) by 0 days.

(21) Appl. No.: 17/112,599

(22) Filed: Dec. 4, 2020

(65) Prior Publication Data

US 2021/0172170 A1 Jun. 10, 2021

(30) Foreign Application Priority Data

Dec. 10, 2019 (GB) ..... 1918148

(51) Int. Cl.

| | |
|---|---|
| ***E04B 9/14*** | (2006.01) |
| ***E04B 9/30*** | (2006.01) |
| ***E04B 1/26*** | (2006.01) |
| ***E04B 9/12*** | (2006.01) |

(52) U.S. Cl.

CPC ..... *E04B 9/14* (2013.01); *E04B 1/26* (2013.01); *E04B 9/127* (2013.01); *E04B 9/30* (2013.01); *E04B 2001/2664* (2013.01)

(58) Field of Classification Search

CPC ..... E04B 9/14; E04B 9/30; E04B 9/18; E04B 9/127; E04B 9/06; E04B 2001/2664; E04B 1/26

USPC .... 52/506.06, 506.07, 506.08, 506.09, 506.1

See application file for complete search history.

(56) References Cited

U.S. PATENT DOCUMENTS

| | | | | |
|---|---|---|---|---|
| 3,089,570 | A * | 5/1963 | O'Neil, Jr. | E04B 9/14 52/713 |
| 3,992,846 | A * | 11/1976 | Tantlinger | E04B 1/6179 52/506.1 |
| 4,281,498 | A | 8/1981 | Kern | |
| 4,292,779 | A * | 10/1981 | Landheer | E04F 13/0812 52/506.1 |
| 4,367,616 | A | 1/1983 | Pearson | |
| 4,406,104 | A | 9/1983 | Beck et al. | |
| 4,454,700 | A | 6/1984 | Kern | |
| 4,674,254 | A | 6/1987 | Koehler et al. | |
| 4,773,200 | A | 9/1988 | Young | |
| 4,841,709 | A | 6/1989 | Peterson et al. | |
| 5,077,951 | A * | 1/1992 | Baker | E04B 9/0478 52/106 |
| 5,218,808 | A | 6/1993 | Ardley | |
| 5,239,801 | A * | 8/1993 | Adams | E04B 9/0478 52/506.07 |
| 5,261,204 | A | 11/1993 | Neff | |
| 5,279,090 | A * | 1/1994 | Yamaguchi | E04B 9/02 454/187 |
| 5,349,800 | A * | 9/1994 | Peng | E04B 9/127 403/174 |
| 5,619,833 | A | 4/1997 | Neff | |

(Continued)

FOREIGN PATENT DOCUMENTS

| | | |
|---|---|---|
| CA | 2055771 | 5/1995 |
| DE | 4236259 | 4/1994 |

(Continued)

*Primary Examiner* — Brent W Herring

(57) ABSTRACT

A suspended ceiling system for supporting panels. The system includes beams and connectors forming keyholes at their junctions. Locking keys are inserted in the keyholes to lock the connectors and beams to each other.

18 Claims, 13 Drawing Sheets

(56) References Cited

U.S. PATENT DOCUMENTS

| | | | | |
|---|---|---|---|---|
| 6,779,315 | B1 * | 8/2004 | Bongio | E04B 9/02 52/506.07 |
| 8,046,966 | B2 * | 11/2011 | Moore | E04B 9/30 52/506.06 |
| 8,528,292 | B2 * | 9/2013 | Morey | E04C 3/02 52/655.1 |
| 9,809,976 | B2 * | 11/2017 | Sareyka | E04B 9/127 |
| 2008/0047213 | A1 | 2/2008 | Jaic | |
| 2008/0060306 | A1 * | 3/2008 | Platt | E04B 9/122 52/506.06 |
| 2010/0005747 | A1 * | 1/2010 | Tedesco | E04B 9/122 52/506.08 |

FOREIGN PATENT DOCUMENTS

| | | |
|---|---|---|
| FR | 2715179 | 9/1997 |
| GB | 954982 | 4/1964 |
| GB | 1061376 | 3/1967 |

* cited by examiner

SUSPENDED CEILING SYSTEM INCORPORATING KEY AND KEYHOLE COMBINATIONS AND METHOD OF INSTALLING SAME

FIELD OF THE INVENTION

The present invention relates to the general field of suspended ceilings, and is more specifically concerned with a suspended ceiling system incorporating key and keyhole assemblies.

BACKGROUND

Suspended ceiling systems are used to provide an aesthetic ceiling surface to a room. In some instances, suspended ceiling systems generally comprise a set of components such as ceiling edge support members, crossbeams and junction elements.

These support members, components and elements are typically attachable or otherwise engageable to one another via compatibly shaped attachment end portions so as to form a planar grid-like structure connected laterally along wall surfaces and to overhanging support structures, or the original ceiling of the room. This grid-like structure typically extends in a common plane disposed in a parallelly spaced apart relationship relative to the original ceiling of the room.

Existing suspended ceiling systems have many disadvantages. For example, the set of components provided to mount and assemble the suspended ceiling system has a fixed aesthetic configuration that is generally preset at the factory for a given room dimension. Thus the end user is limited to the preset configuration and its associated aesthetics.

Furthermore, the compatibly shaped attachment end portions between the members, components and elements, are often rendered unusable if, for some reasons, some elongated crossbeams or support members need to shortened due to, for example, a miscalculation of the dimensions of the destination room, or a modification of the desired design. In other words, these systems leave no margin for on site error corrections or modification of the design.

Furthermore, these suspended ceiling systems generally require experienced professionals specifically trained for installing the desired brand or model of system, which raises the overall cost of the suspended ceiling once installed.

Thus, there is a need on the market for an improved suspended ceiling system.

Against this background, there exists a need in the industry to provide suspended ceiling system mitigating at least in part the above-noted disadvantages of existing suspended ceiling system. An object of the present invention is therefore to provide such suspended ceiling systems.

SUMMARY OF THE INVENTION

In a broad aspect, there is provided a suspended ceiling system for suspending panels, comprising: a plurality of elongated beams each defining a beam longitudinal axis, each of the beams defining longitudinally opposed beam end sections; a plurality of connectors for connecting the beams to each other to form a panel support structure for supporting the panels, each of the connectors defining at least two spaced apart beam coupling sections for each coupling to a respective one of the beams through one of the beam end sections; and a plurality of locking keys for selectively locking the connectors and beams to each other; wherein, with the suspended ceiling system assembled, the beams are joined to each other by the connectors to form a grid configured for supporting the panels, the beams and connectors forming connector-to-beam junctions each including one of the beam end sections and one of the beam coupling sections engaging each other and together defining a keyhole, the keyhole including keyhole beam and connector portions defined respectively by the one of the beam end and coupling sections, the keyhole receiving thereinto one of the locking keys so that movements of the one of the beam end sections and the one of the beam coupling sections relative to each other perpendicularly to the keyhole are prevented to secure the one of the beam end sections and the one of the beam coupling sections to each other.

There may also be provided a suspended ceiling system wherein the keyhole is elongated and extends substantially parallel to the beam longitudinal axis.

There may also be provided a suspended ceiling system wherein each connector-to-beam junction is configured and sized to allow relative movements between the beam end section and the beam coupling section perpendicularly to the beam longitudinal axis when the locking key is removed from the keyhole.

There may also be provided a suspended ceiling system wherein the locking key is slidable toollessly in the keyhole.

There may also be provided a suspended ceiling system wherein the locking key includes a substantially elongated key body of substantially constant transversal cross-sectional configuration therealong.

There may also be provided a suspended ceiling system wherein the locking key further includes a handling portion extending from the key body and protruding laterally relative thereto.

There may also be provided a suspended ceiling system wherein the beam coupling section defines a longitudinal coupling section groove extending thereinto, the keyhole connector portion extending from the coupling section groove laterally relative thereto into the beam coupling section; and the beam end section defines a protrusion inserted in the coupling section groove when the beam coupling section and the beam end section are joined to each other, the keyhole beam portion extending in the protrusion laterally relative thereto so that when the beam coupling section and the beam end section are joined to each other, the keyhole beam and coupling portions face each other to together define the keyhole.

There may also be provided a suspended ceiling system wherein the protrusion extends substantially along the entirety of the beam and wherein opposed keyhole beam portions provided in each beam end section are joined to each other through a keyhole groove so that the keyhole groove and keyhole beam portions together defines a longitudinal groove of substantially constant transversal cross-sectional configuration therealong extending along the entirety of the protrusion.

There may also be provided a suspended ceiling system wherein at least some of the beams each define a pair of panel support flanges laterally protruding from the protrusion opposed to each other so that the at least some of the beams each have generally T-shaped cross-sectional configuration.

There may also be provided a suspended ceiling system further comprising decorative elements supported in register with the connectors to hide the connectors, the decorative elements each defining a decorative element keyhole portion positioned in prolongation of the keyhole beam portions so that a single locking key locks both one of the beams and the decorative element to the connector when the suspended ceiling system is assembled.

There may also be provided a suspended ceiling system wherein the plurality of connectors includes T-shaped edge connectors having three edge arms each provided with a respective beam coupling section, L-shaped corner connectors having two corner arms each provided with a respective beam coupling section and X-shaped middle connectors having four middle arms each provided with a respective beam coupling section, wherein, when the suspended ceiling system is assembled, the edge connector and corner connectors are provided at a periphery of the suspended ceiling system and the middle connectors are provided inside the periphery of the suspended ceiling system.

There may also be provided a suspended ceiling system further comprising a plurality of mounting brackets mountable to a wall, each mounting bracket including a wall mount mountable to a wall and a connector support extending therefrom, the connector support being configured for supporting thereonto the edge and corner connectors.

There may also be provided a suspended ceiling system wherein the connector support includes a support top surface facing upwardly when the connector support is operatively mounted to the wall and a connector protrusion protruding from the support top surface, and wherein the corner and edge connectors each define a mounting groove extending therealong for receiving the connector protrusion when supported by the mounting bracket.

There may also be provided a suspended ceiling system further comprising a guide tool including a body configured for engaging the mounting brackets and a wire extending therefrom for indicating an horizontal direction along which the system is to be assembled.

There may also be provided a suspended ceiling system wherein at least some of the middle connectors are provided with a support extending upwardly therefrom or securing the at least some of the middle connectors to an overhanging structure.

There may also be provided a suspended ceiling system wherein the plurality of connectors includes edge connectors having four edge connector arms each provided with a respective beam coupling section, two of the edge connector arms being colinear, with remaining connector arms forming a V-shape and extending from the two of the edge connector arms, corner connectors having three corner arms each provided with a respective beam coupling section, two of the corner arms being perpendicular to each other and being bisected by a remaining arm and X-shaped middle connectors having four middle arms each provided with a respective beam coupling section, wherein, when the suspended ceiling system is assembled, the edge connector and corner connectors are provided at a periphery of the suspended ceiling system and the middle connectors are provided inside the periphery of the suspended ceiling system.

There may also be provided a suspended ceiling system wherein the connectors and beams are all made of wood.

There may also be provided a suspended ceiling system comprising the suspended ceiling system according to claim 1 in an assembled configuration in which the grid is defined, and panels supported by the suspension system to fill empty spaces defined by the grid.

Advantageously, the proposed suspended ceiling can be relatively easily mounted, and eventually as easily disassembled if desired, mostly toollessly, using only a relatively small number steps in which only of the most basic carpenter tools such as a hammer, nails, a hand saw and a level tool are needed.

Further advantageously, the customizable suspended ceiling system allows a user to relatively easily customize the latter between a relatively simple ornamental moulding pattern, and a highly complex design pattern visible along the surface of the suspended ceiling system using a relatively small basic set of modular components thereof.

Other objects, advantages and features of the present invention will become more apparent upon reading of the following non-restrictive description of some embodiments thereof, given by way of example only with reference to the accompanying drawings.

BRIEF DESCRIPTION OF THE DRAWINGS

FIG. 61, in a perspective view, illustrates a pair grid-like structures of the suspended ceiling system of FIG. 1, here show mounted vertically in a self-standing V-shaped configuration and used as a support for a marketing backdrop at a trade show boot or the like.

DETAILED DESCRIPTION

The terms "substantially" and "about" are used throughout this document to indicate variations in the thus qualified terms. These variations are variations that do not materially affect the manner in which the invention works and can be due, for example, to uncertainty in manufacturing processes or to small deviations from a nominal value or ideal shape that do not cause significant changes to the invention. Also, the present document describes the proposed system using directional terminology with reference to a substantially horizontal ceiling assembled using the proposed system. This terminology is for convenience purposes and should not be used to restrict the scope of the appended claims unless explicitly claimed.

Figure 1:
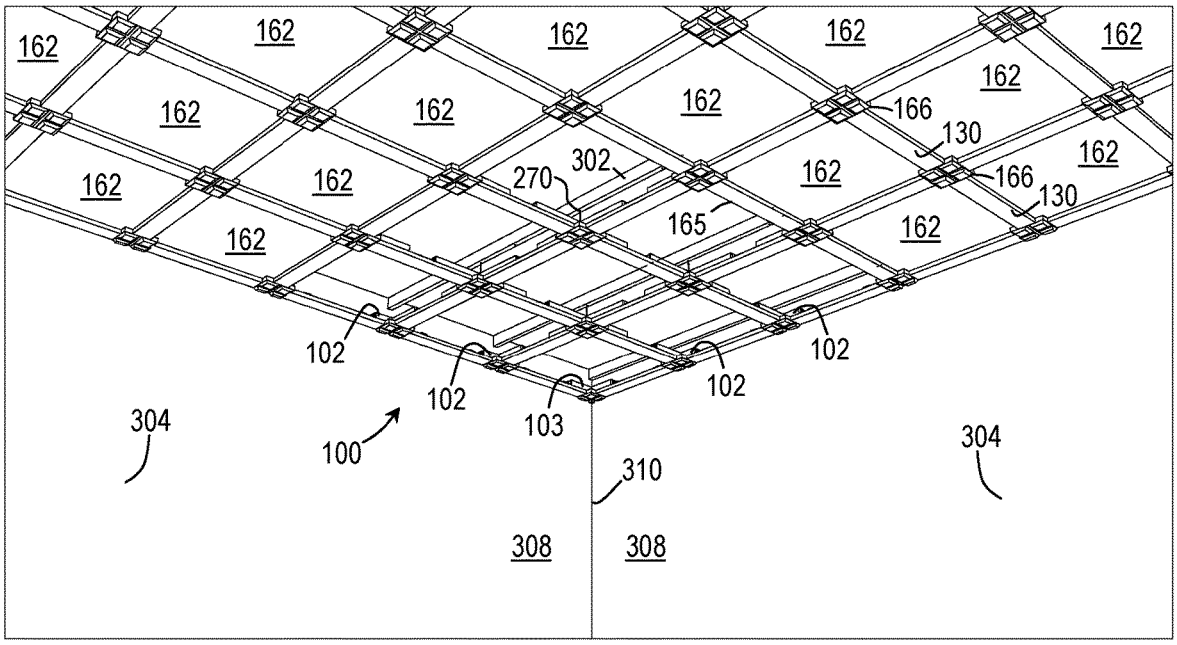
FIG. 1, in a perspective view, illustrates an embodiment of a suspended ceiling system, according to the present invention.
Figure 2:
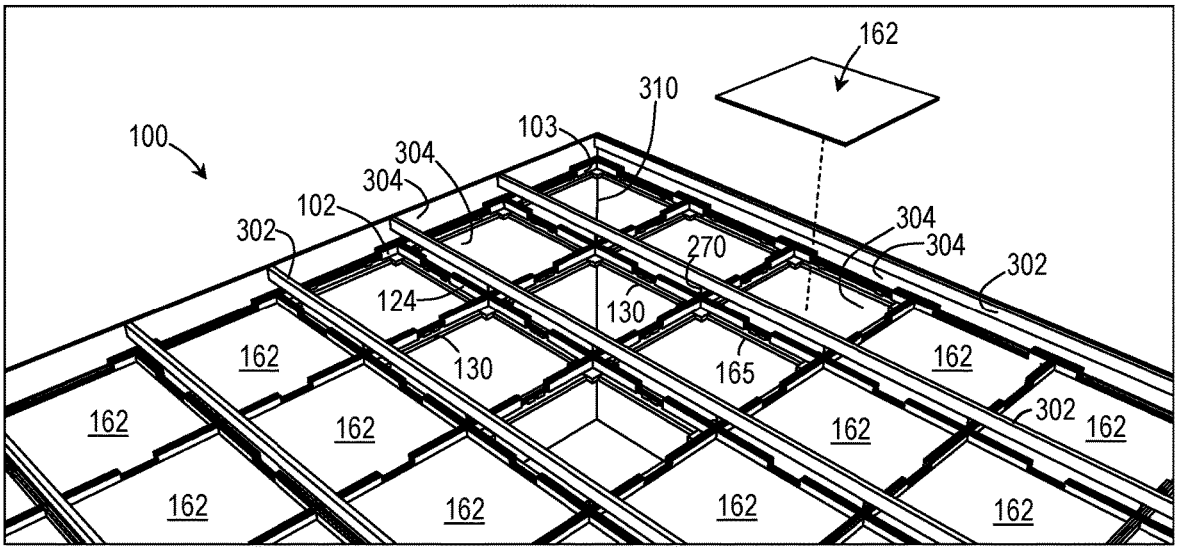
FIG. 2, in an alternative perspective view, illustrate the suspended ceiling system of FIG. 1.

FIGS. 1 and 2 collectively illustrate various aspects of an embodiment, according to the present invention, of a suspended ceiling system 100, hereinafter "the system 100", usable for installation along a common plane, typically extending substantially parallelly adjacently the original ceiling or overhanging support structure 302 of a room, and laterally across the walls 304 thereof.

Figure 3:
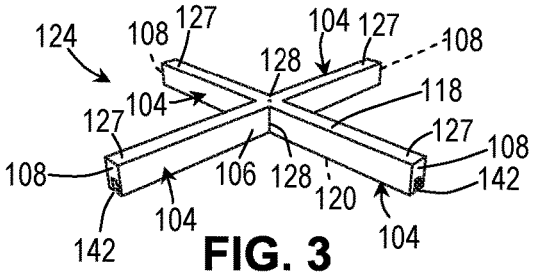
FIG. 3, in a perspective view, illustrates a connector part of the suspended ceiling system of FIG. 1.
Figure 4:
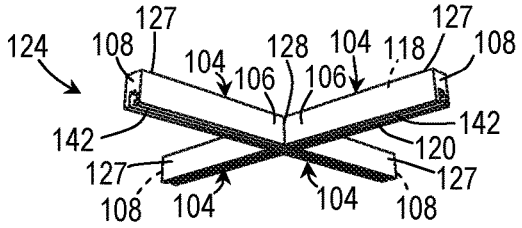
FIG. 4, in an alternative perspective view, illustrates the connector of FIG. 3.
Figure 5:
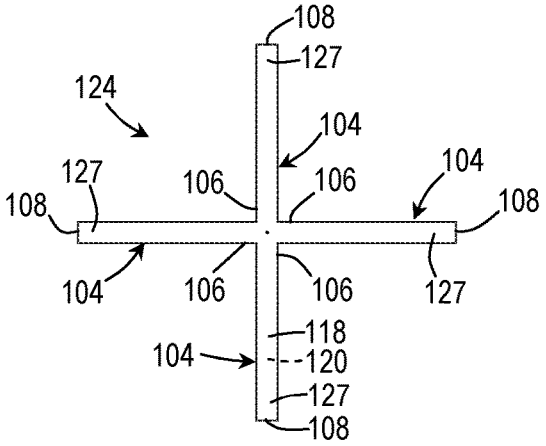
FIG. 5, in top plan view, illustrates the connector of FIG. 3.
Figure 6:
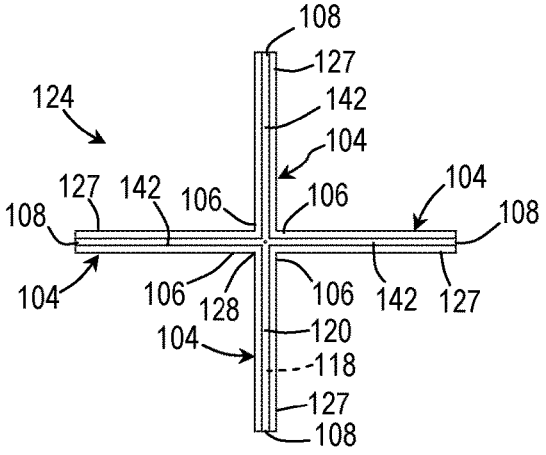
FIG. 6, in a bottom plan view, illustrates the connector of FIG. 3.
Figure 7:
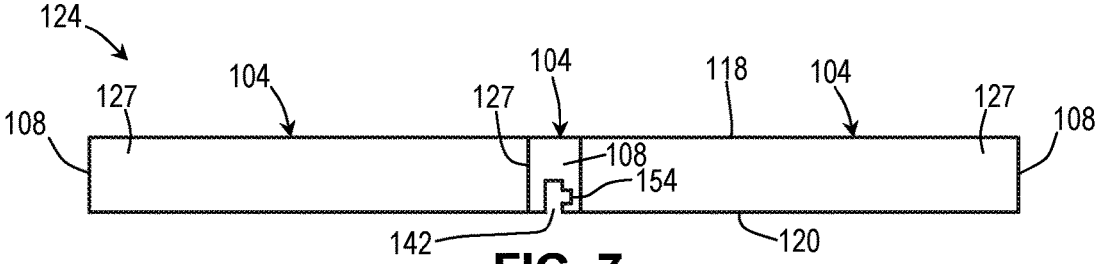
FIG. 7, in a side elevation view, illustrates the connector of FIG. 3.
Figure 8:
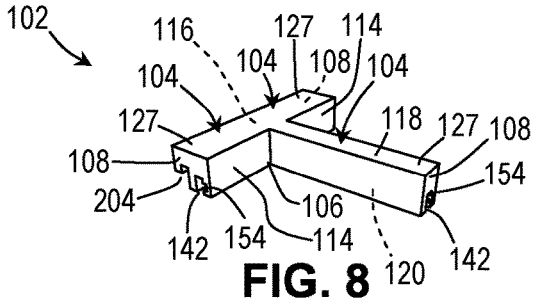
FIG. 8, in a perspective view, illustrates an other connector also part of the suspended ceiling system of FIG. 1.
Figure 9:
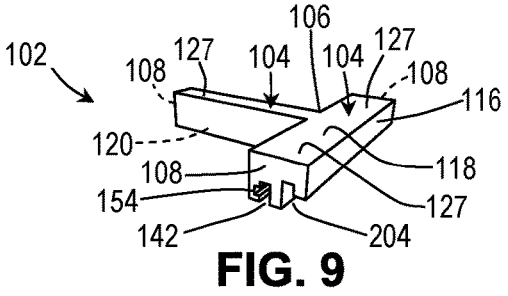
FIG. 9, in an alternative perspective view, illustrates the connector of FIG. 8.
Figure 10:
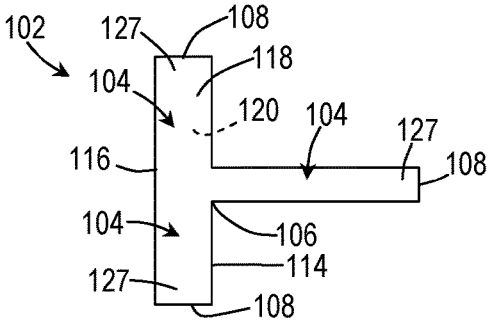
FIG. 10, in top plan view, illustrates the connector of FIG. 8.
Figure 11:
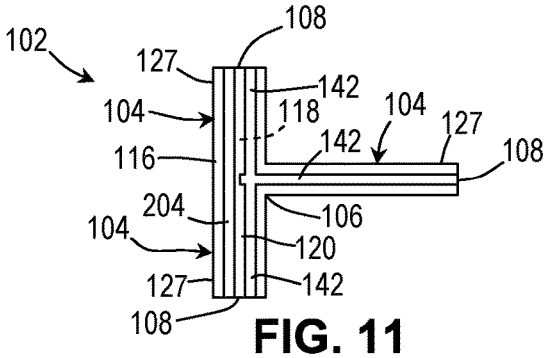
FIG. 11, in a bottom plan view, illustrates the connector of FIG. 8.
Figure 12:
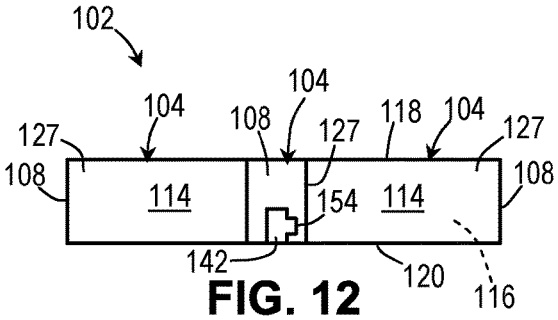
FIG. 12, in a front elevation view, illustrates the connector of FIG. 8.
Figure 13:
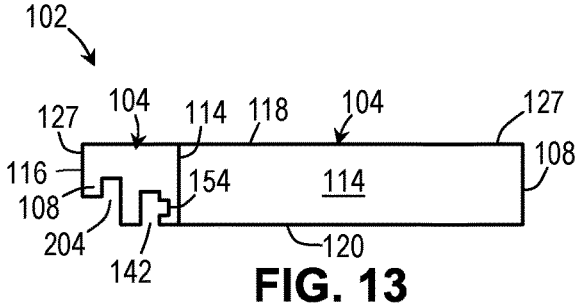
FIG. 13, in a side elevation view, illustrates the connector of FIG. 8.
Figure 14:
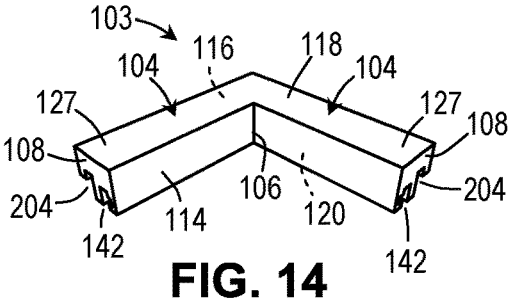
FIG. 14, in a perspective view, illustrates yet an other connector also part of the suspended ceiling system of FIG. 1.
Figure 15:
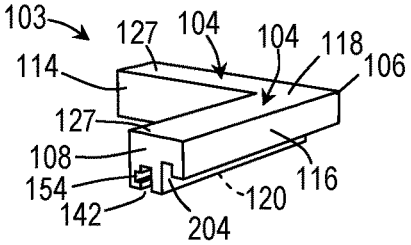
FIG. 15, in an alternative perspective view, illustrates the connector of FIG. 14.
Figure 16:
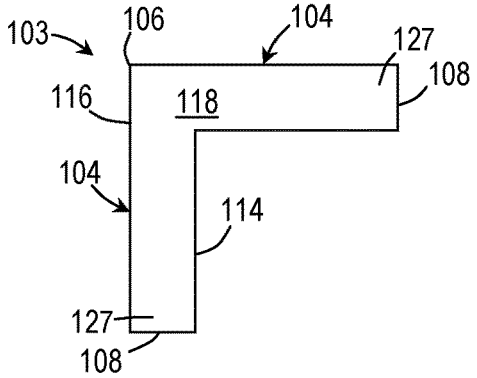
FIG. 16, in top plan view, illustrates the connector of FIG. 14.
Figure 17:
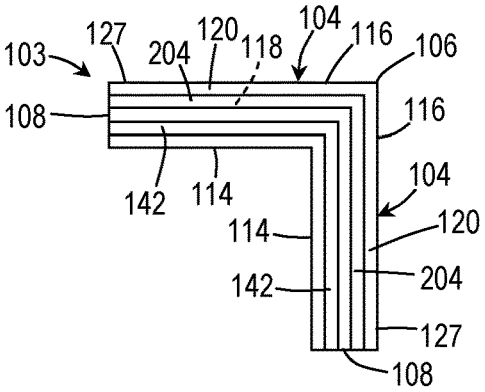
FIG. 17, in a bottom plan view, illustrates the connector of FIG. 14.
Figure 18:
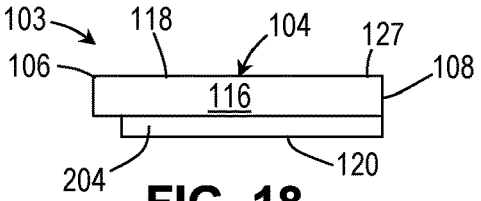
FIG. 18, in a front elevation view, illustrates the connector of FIG. 14.
Figure 19:
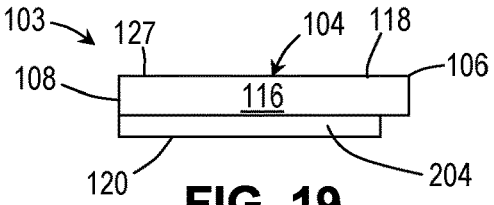
FIG. 19, in a first side elevation view, illustrates the connector of FIG. 14.
Figure 20:
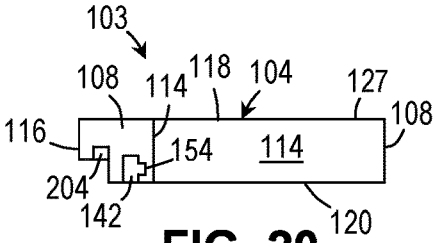
FIG. 20, in a rear elevation view, illustrates the connector of FIG. 14.
Figure 21:
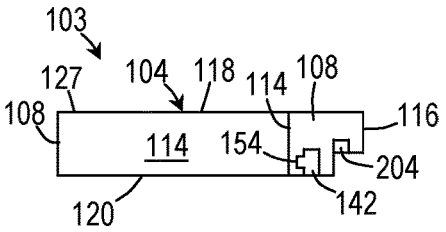
FIG. 21, in a second side elevation view, illustrates the connector of FIG. 14.
Figure 27:
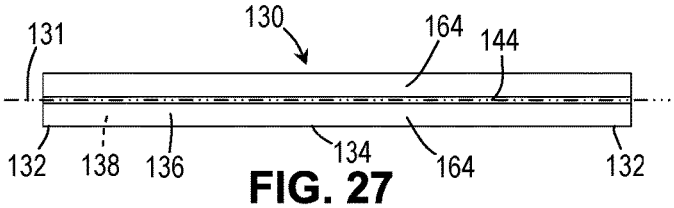
FIG. 27, in a top plan view, illustrates the beam of FIG. 26.

Referring to FIG. 2, the system 100 includes a plurality of elongated beams 130. As seen in FIG. 27 for example, each beam 130 defines a beam longitudinal axis 131 and longitudinally opposed beam end sections 132. Returning to FIG. 2, the system 100 further includes a plurality of connectors 102, 103 and 124 for connecting the beams 130 to each other to form a panel support structure for supporting panels 162. Referring for example to FIG. 3, each of the connectors 124 defines at least two spaced apart beam coupling sections 127 for each coupling to one of the beam end sections 132. For example, the connectors 102, 103 and 124 include respectively three, two and four beam coupling sections 127, as seen for example respectively in FIGS. 8, 14 and 3.

Figure 34:
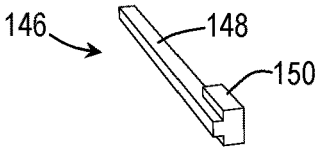
FIG. 34, in a perspective view, illustrates a locking key part of the suspended ceiling system of FIG. 1.
Figure 35:
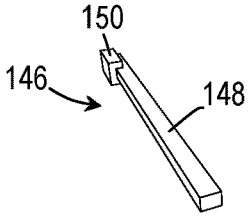
FIG. 35, in an alternative perspective view, illustrates the locking key of FIG. 34.
Figure 36:
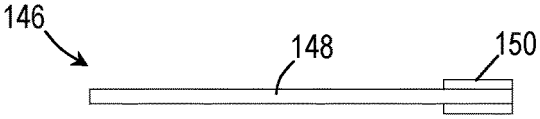
FIG. 36, in first side elevation view, illustrates the locking key of FIG. 34.
Figure 38:
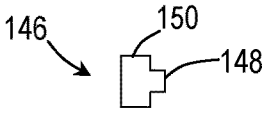
FIG. 38, in a rear end view, illustrates the locking key of FIG. 34.
Figure 37:
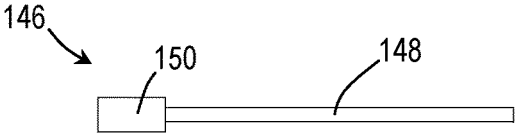
FIG. 37, in second side elevation view, illustrates the locking key of FIG. 34.
Figure 39:
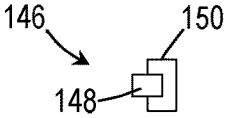
FIG. 39, in a front end view, illustrates the locking key of FIG. 34.
Figure 40:
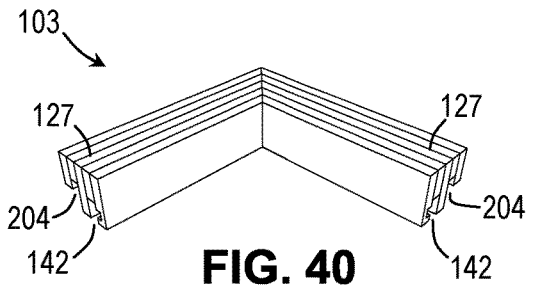
FIG. 40, in a perspective view, illustrate an alternative embodiment of the connector of FIG. 14.
Figure 41:
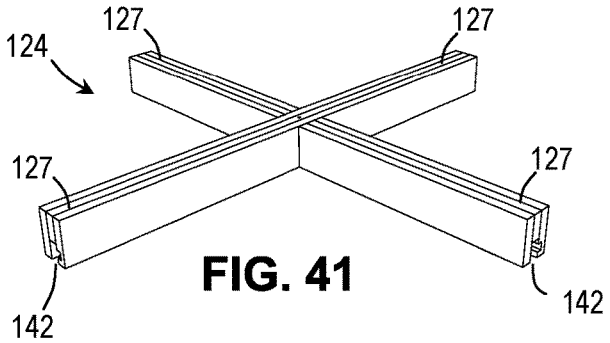
FIG. 41, in a perspective view, illustrate an alternative embodiment of the connector of FIG. 3.
Figure 42:
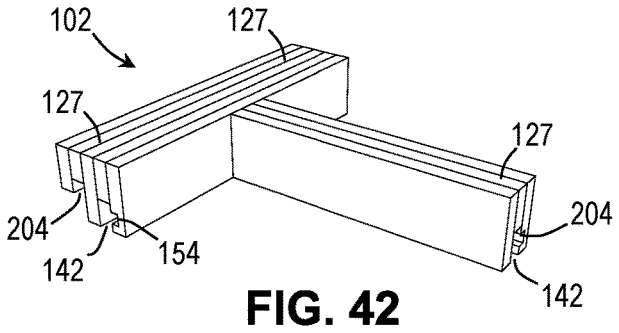
FIG. 42, in a perspective view, illustrate an alternative embodiment of the connector of FIG. 8.
Figure 43:
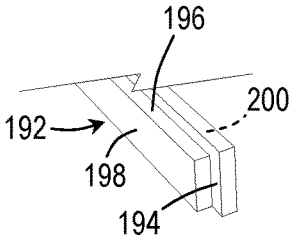
FIG. 43, in a perspective view, illustrate an alternative embodiment of the mounting bracket of FIG. 22.
Figure 44:
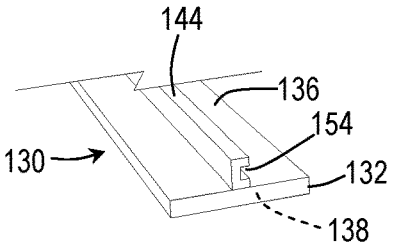
FIG. 44, in a perspective view, illustrate an alternative embodiment of the beam of FIG. 26.
Figure 45:
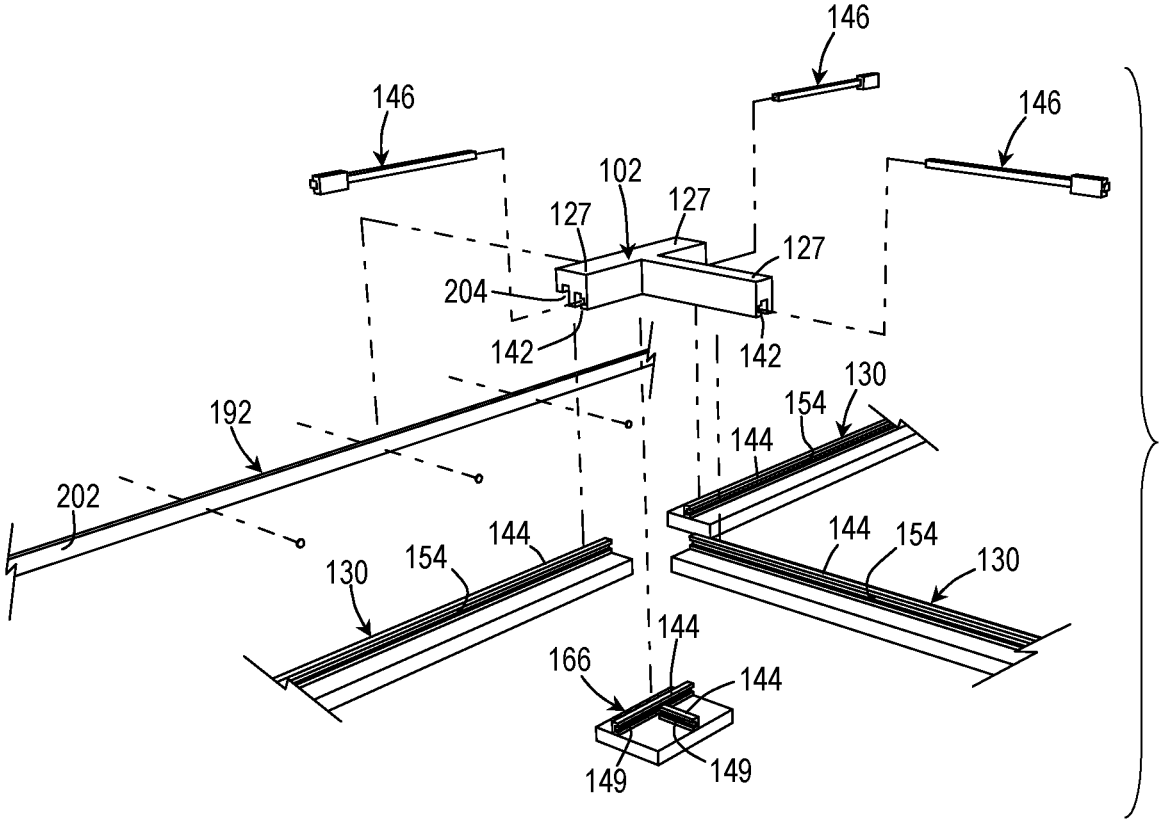
FIG. 45, in a perspective exploded view, illustrates assembly of various components of the system of FIG. 1 to each other in which the connector of FIG. 8 is used.

A plurality of locking keys 146, seen for example in FIG. 34, are provided for selectively locking the connectors 102, 103 and 124 and beams 130 to each other.

Figure 60:
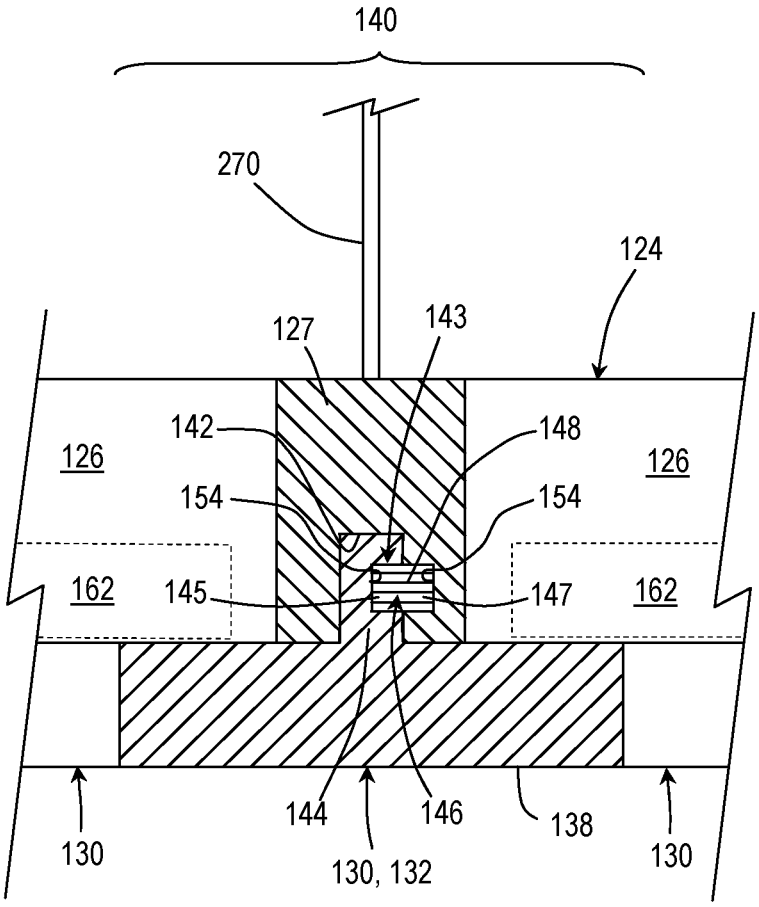
FIG. 60, in a side elevational cut-away view, illustrates engagement between the locking keys and keyholes formed by beams and connectors in which the locking key secures one beam and one connector to each other.

As seen in FIG. 2, when the system 100 is assembled, the beams 130 are joined to each other by the connectors 102, 103 and 124 to form a grid configured for supporting the panels 162. Referring for example to FIG. 60, the beams 130 and connectors 102, 103 and 124 form connector-to-beam junctions 140 each including one of the beam end sections 132 and one of the beam coupling sections 127 engaging each other and together defining a keyhole 143, the keyhole 143 including keyhole beam and connector portions 145 and 147 defined respectively by the one of the beam end and coupling sections 132 and 127. The keyhole 143 receives thereinto one of the locking keys 146 so that movements of the one of the beam end sections 132 and the one of the beam coupling sections 127 relative to each other perpendicularly to the keyhole 143 are prevented to secure the one of the beam end sections 132 and the one of the beam coupling sections 127 to each other.

Typically, the keyholes 143 are elongated and extend substantially parallel to the beam longitudinal axis 131. Each connector-to-beam junction 140 is configured and sized to allow relative movements between the beam end section 132 and the beam coupling section 127 perpendicularly to the beam longitudinal axis 131 when the locking key is 146 removed from the keyhole 143. Typically, the locking key 146 is slidable toollessly in the keyhole 143, but locking keys 146 requiring a hammer or other tool for such insertion are possible, for example if fit between the locking key 146 and keyhole 143 is very tight.

Figure 22:
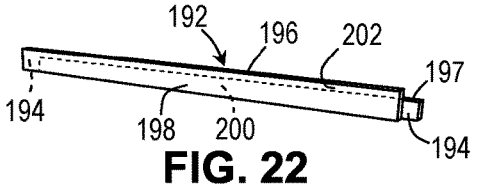
FIG. 22, in a perspective view, illustrates a mounting bracket part of the suspended ceiling system of FIG. 1.
Figure 23:
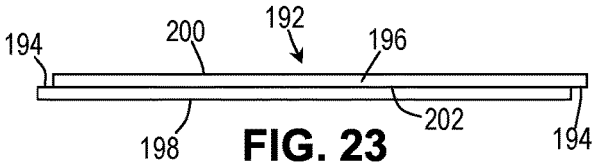
FIG. 23, in top plan view, illustrates the mounting bracket of FIG. 22.
Figure 24:
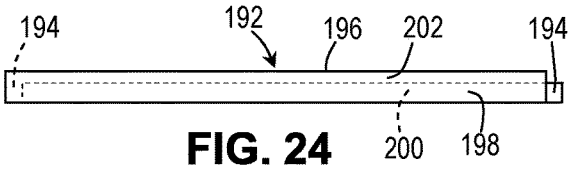
FIG. 24, in a front elevation view, illustrates the mounting bracket of FIG. 22.
Figure 25:
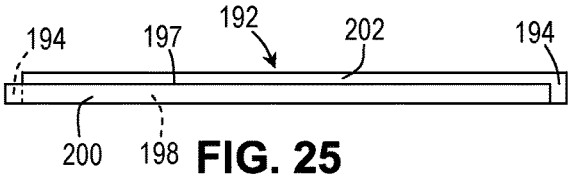
FIG. 25, in a rear elevation view, illustrates the mounting bracket of FIG. 22.

The connectors 102 and 103 are typically used at a periphery of the system 100 when the latter is assembled, while the connectors 124 are used inside the periphery of the system 100. The connectors 102 and 103 could be directly secured to the walls 304 in some embodiments, for example using screws, nails, or an adhesive. However, in the embodiment of the system 100 shown in the drawings, mounting brackets 192, seen for example in FIG. 22, are secured to the walls 304, and the connectors 102 and 103 are then mounted thereto.

The system 100 includes a plurality of connectors 102, which are in some embodiments substantially T-shaped, and connectors 103, which are in some embodiments substantially L-shaped. Each one of the connectors 103, seen for example in FIG. 14, includes two arms 104. Each one of the connectors 103, seen for example in FIG. 8, includes three arms 104. As best illustrated in FIGS. 10, 11, 16 and 17, each arm 104 has a substantially elongated configuration and defines a proximal end 106 and a distal end 108, the beam end sections 127 being defined at the latter. The arms 104 are joined to one another at their respective proximal ends 106 and each extend in the common plane of the system 100. The arms 104 may all have similar lengths or may be of different lengths.

As best illustrated in FIGS. 8, 9, 14 and 15, the connectors 102 and 103 define laterally oriented inner and outer longitudinal side surfaces 114 and 116 respectively, and, a pair of oppositely oriented upper side and underside surfaces 118 and 120 extending parallelly relative to the common plane of the system 100.

The connectors 102 and 103 further defines a predetermined angle between the longitudinal extension of the arms 104. In the connector 102, two of the arms 104 are colinear, and the third arm 104 extends perpendicularly relative thereto, typically in the common plane of the system 100. In the connector 103, the two arms 104 are perpendicular to each other, forming angles of 90 or 270 degrees with each other at the inner longitudinal side surfaces 114, to fit inside and outside corners between two walls 304. It should be noted that for some applications in which the walls 304 are note perpendicular to each other, the two arms 104 may be angled with any other suitable angle therebetween.

FIGS. 3 to 7 illustrate the connectors 124. Each one of the connectors 124 includes at least four arms 104. Each arm 104 has a substantially elongated configuration and defining a proximal end 106 and a distal end 108, the beam coupling sections 127 being formed at the latter. The at least four arms 104 are joined to one another at their respective proximal end 106 and extend away from each other in the common plane to form a cross-shaped configuration.

Thus, each one of the connectors 124 defines a pair of oppositely oriented upper side and underside surfaces 118 and 120 extending parallelly relative to the common plane of the system 100, and four corner edges 128 extending laterally inwardly between the arms 104 and parallelly relative to the common plane.

Figure 28:
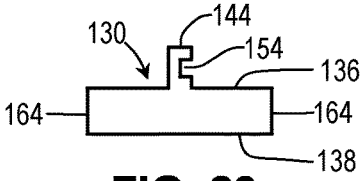
FIG. 28, in a front end view, illustrates the beam of FIG. 26.
Figure 29:
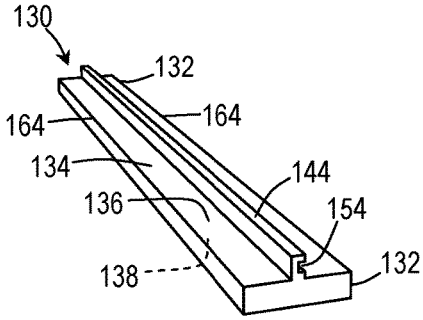
FIG. 29, in a perspective view, illustrates the beam of FIG. 26.
Figure 30:
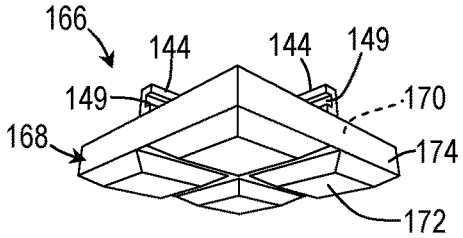
FIG. 30, in a perspective view, illustrates a decorative element part of the suspended ceiling system of FIG. 1.
Figure 31:
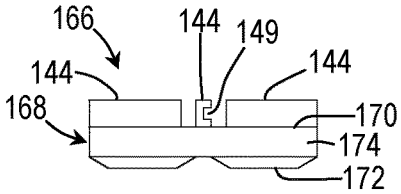
FIG. 31, in a front end view, illustrates the decorative element of FIG. 30.
Figure 32:
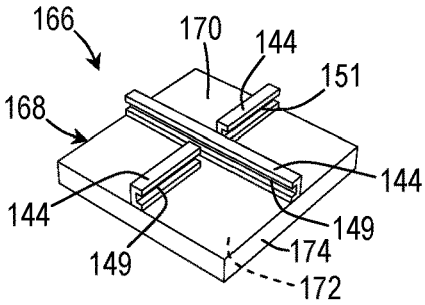
FIG. 32, in an alternative perspective view, illustrates the decorative element of FIG. 30.
Figure 33:
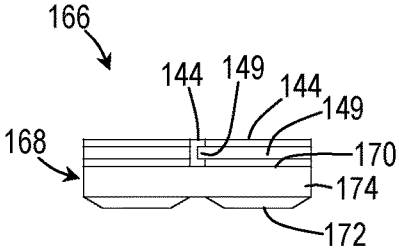
FIG. 33, in a side elevation view, illustrates the decorative element of FIG. 30.

FIGS. 27, 28 and 29 inclusively, illustrate one of the beams 130. Each one of the beams 130 has a substantially elongated configuration defining a pair of opposite beam end sections 132, an intermediate portion 134 extending therebetween, and opposed upper side and underside longitudinal surfaces 136 and 138 extending parallelly relative to the common plane of the system 100.

Figure 46:
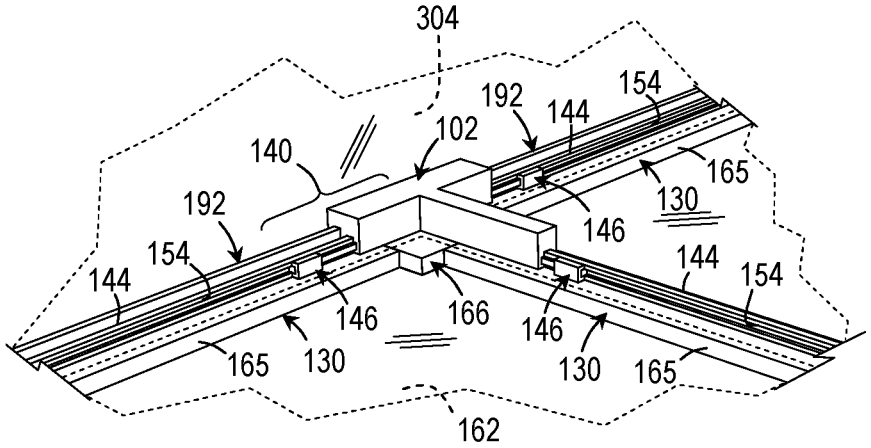
FIG. 46, in a perspective view, illustrates the components of FIG. 45 assembled to each other.
Figure 47:
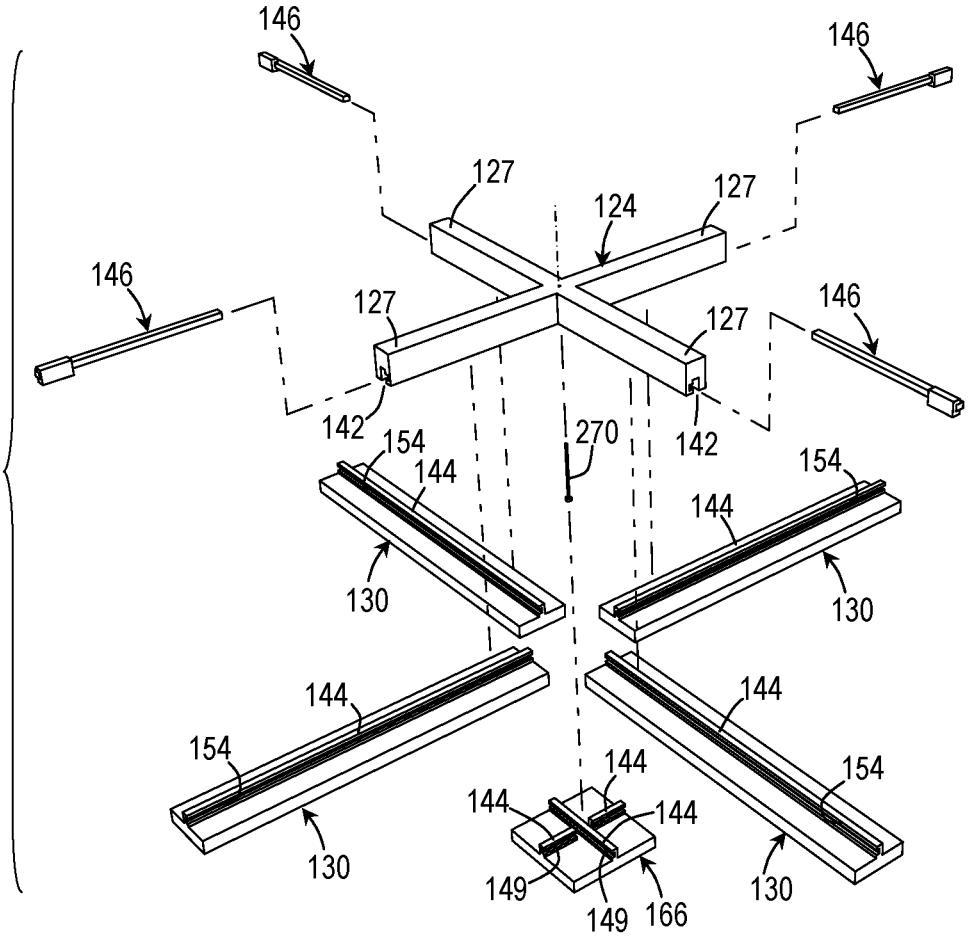
FIG. 47, in a perspective exploded view, illustrates assembly of various components of the system of FIG. 1 to each other in which the connector of FIG. 3 is used.
Figure 48:
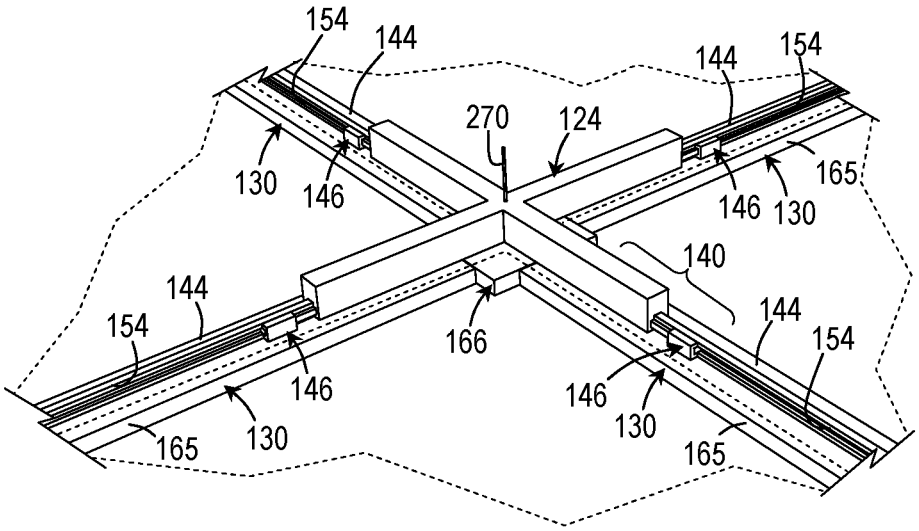
FIG. 48, in a perspective view, illustrates the components of FIG. 47 assembled to each other.
Figure 49:
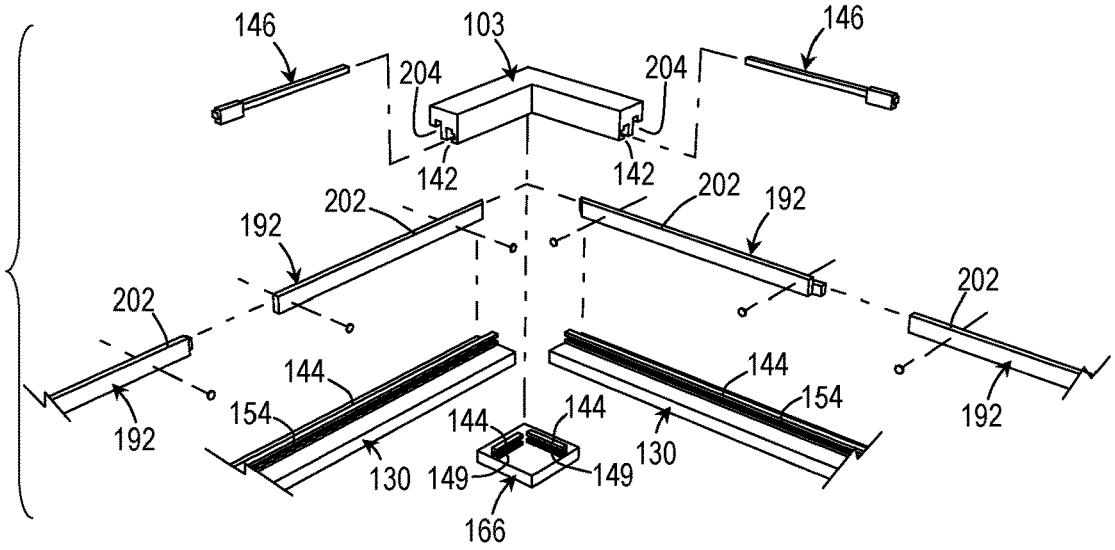
FIG. 49, in a perspective exploded view, illustrates assembly of various components of the system of FIG. 1 to each other in which the connector of FIG. 14 is used.
Figure 50:
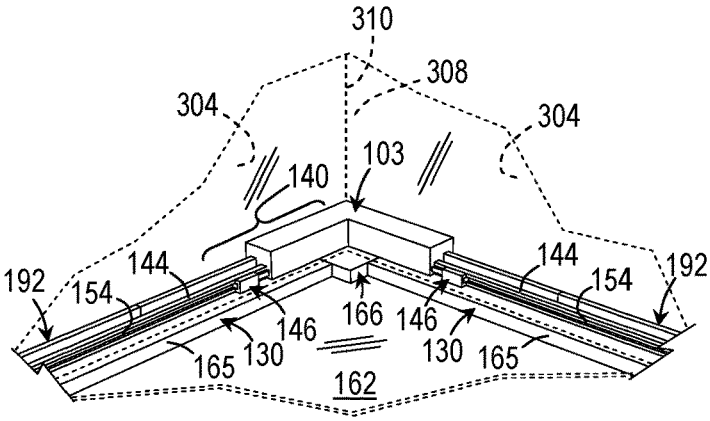
FIG. 50, in a perspective view, illustrates the components of FIG. 49 assembled to each other.
Figure 51:
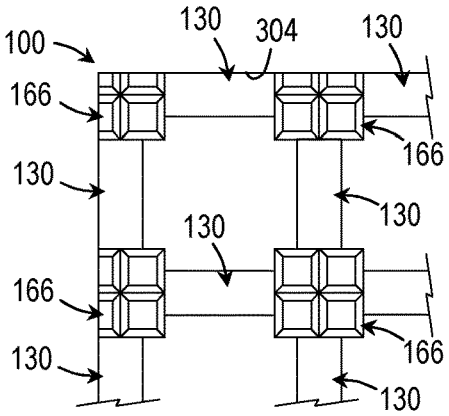
FIG. 51, in a bottom plan view, illustrates a configuration of the suspended ceiling system of FIG. 1 in which a first aesthetic aspect is achieved.
Figure 52:
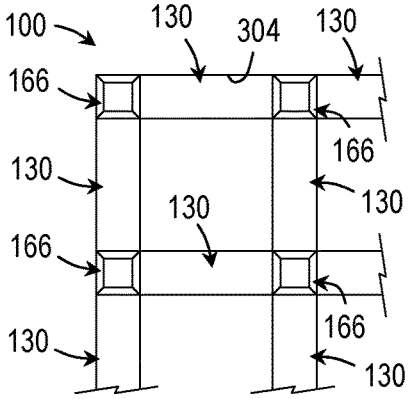
FIG. 52, in a bottom plan view, illustrates a configuration of the suspended ceiling system of FIG. 1 in which a second aesthetic aspect is achieved.

Referring to FIGS. 46, 48 and 50, the system 100 typically defines a plurality of connector-to-beam junctions 140 in corresponding number to the number of arms 104 in the system 100, although leaving some of the arms 104 unsecured to a beam 130 is within the scope of the invention. As illustrated in FIGS. 7, 11, 12, 13, 17, 20 and 21, each one of the connector-to-beam junctions 140 includes a longitudinal coupling section groove 142 extending at least partially longitudinally inwardly from each arm distal end 108 and into the beam coupling section 127, in the underside surface 120 of the respective arm 104. As illustrated in FIGS. 27 to 29, each one of the connector-to-beam junction 140 further includes a protrusion 144 extending at least along an upper side longitudinal portion of each opposed beam end portions 132 of each beam 130.

Referring now more particularly to FIGS. 34 to 39, each one of the connector-to-beam junction 140 further includes the locking key 146. The locking key 146 has a substantially elongated configuration defining a substantially elongated key body 148 of substantially constant transversal cross-sectional configuration therealong, and an optional handling portion 150 at one end thereof and extending from the key body 148 and protruding laterally relative thereto.

Referring now more particularly to FIG. 60, the coupling section groove 142 is shaped and sized for longitudinally receiving in a snug fit relation at least a longitudinally extending portion of a respective one of the protrusions 144 of the beam 130, such that the upper side longitudinal surface 136 thereof is proximally parallelly facing the underside longitudinal surface portion of the respective arm 104.

The coupling section groove 142 and the protrusion 144 cooperatively define a pair of oppositely facing surfaces 154 extending substantially perpendicularly relative to the upper side longitudinal surface 136 of the beam 130. The keyhole connector portion 147 extends from the coupling section groove 142 laterally relative thereto into the beam coupling section 127, or in other words in the surface 154 of the connector 102, 103 or 124. Similarly, the keyhole beam portion 145 extends in the protrusion 144 laterally relative thereto, into the surface 154 of the protrusion 144, so that when the beam coupling section 127 and the beam end section 132 are joined to each other, the keyhole beam and connector portions 145 and 147 face each other to together define the keyhole 143.

Figure 26:
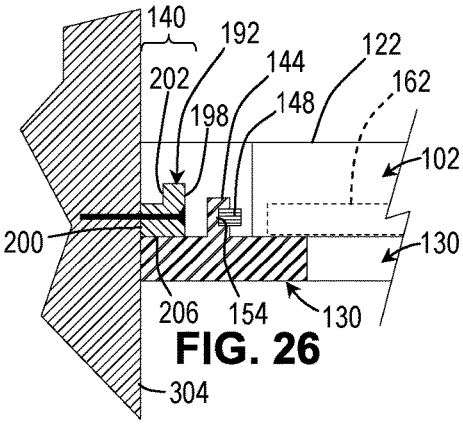
FIG. 26, in a side elevational cross-sectional view, illustrates the mounting bracket of FIG. 22 secured to a wall and engaged with the connector of FIG. 9, the latter being secured using a locking key to a beam, both part of the suspended ceiling system of FIG. 1.

The keyhole 143 is shaped and sized for slidably longitudinally receiving therein in a snug fit relation the body 148 of the locking key 146, so as to transversally lock the respective beam end portion 132 of the beam 130 with the respective arm 104, as best illustrated in FIGS. 26 and 60.

Referring to FIGS. 1, 2, and 45 to 50 inclusively, a method of installing the customizable suspended ceiling system 100 of the present invention will now be described. In a first step, the plurality of connectors 102 and 103 have their respective outer longitudinal side surface 116 engaged in a suitably spaced apart relationship along the flat wall surfaces 304 and wall corners 310 of the room. In a second step, a suitable number of beams 130 and connectors 124 may be successively assembled to form a substantially regular grid-like structure extending between the plurality of connectors 102 and 103 by lockingly engaging the connector-to-beam junctions 140 therebetween using locking keys 146, as illustrated in FIGS. 45 to 50 inclusively, the end result being the assembled suspended ceiling system 100 as illustrated in FIGS. 1 and 2. As it will be made apparent from the description hereinafter, optional steps may be added to the method described above with regards to additional elements that can be added to the invention such as drop-in panels 162, adjustable support components 272 and wall mount arrangements 190.

Referring to FIGS. 2, 29, 46, 48 and 50, in some embodiments of the system 100 according to the present invention, the beams 130 forming the opening edges 165 in the grid-like structure each have their respective upper side surface 136 extending at least slightly laterally away from their respective protrusion 144, and inwardly relative to the opening of the grid-like structure, so as to form a panel support flanges 164 extending longitudinally therealong. The beams connected to the connectors 124 each define a pair of laterally protruding panel support flanges 164 from the protrusion 144, opposed to each other, so that the beams 130 connected to the connectors 124 each have generally T-shaped cross-sectional configuration. In some embodiments, even the beams used at the periphery of the system 100 have this T-shaped configuration, for example if mounting brackets 192, described below, are used.

The system 100 is typically used in combination with a sufficient number of suitably sized and shaped drop-in panels 162 for closing each opening of the grid-like structure with the edges of the panels 162 resting on the panel support flanges 164, so as to cooperatively form with the grid-like structure a ceiling surface.

Referring to FIGS. 1, 30 to 33 and 51 to 53, in some embodiments of the system 100, the system 100 further comprises a plurality of decorative elements 166 that are user selectively attachable to connectors 102, 103 and 124. Each decorative element 166 includes a plate member 168 defining an upper side surface 170, an underside surface 172 and a contour edge 174. Furthermore, each decorative element 166 further includes two or more of the protrusions 144 located along the upper side surface 170 thereof, and in register for engagement with a respective connector groove 142 along the underside surface 172 of user selected connectors 102, 103 and 124.

Furthermore, each decorative element 166 has a dimension in the common plane of the system 100 that is at least sufficiently smaller than the respective connector 102, 103 or 124 is attached, so as to allow beams 130 to be attached to a respective arm 104 thereof via the connector-to-beam junction 140. In some embodiments, the decorative elements 166 are configured to be supported in register with the connectors 102, 103 and 124 to hide the connectors 102, 103 and 124, and define a keyhole decorative element portion 149, similar to the keyhole beam portion 145, and positioned in prolongation of the keyhole beam portions 145, so that a single locking key 146 locks both one of the beams 130 and the decorative element 166 to the connector 102, 103 and 124 when the suspended ceiling system 100 is assembled As best illustrated in FIGS. 27 and 29, in some embodiments of the system 100, the protrusion 144 extend longitudinally along the whole length of the beam 130, and opposed keyhole beam portions 145 provided in each beam end section 132 are joined to each other through keyhole decorative element portion 149 so that the keyhole decorative element portion 149 and keyhole beam portions 145 together define a longitudinal groove of substantially constant transversal cross-sectional configuration therealong extending along the entirety of the protrusion 144.

Thus, advantageously, the system 100 may be provided with a sufficient number of beams 130 having each a same overall length that is equal to or greater than the greatest distance between two components of the system 100 so as to allow a user to cut selected beams 130 to any desired length within that overall length of each beam 130.

As best illustrated in FIGS. 6, 7, 11 and 13, in some embodiments of the system 100, the grooves 142 all extend along the whole arms 104, so that selected beams 130 may extend longitudinally across selected connectors 102, 103 and 124 and decorative elements 166.

Advantageously, the protrusion 144, the groove 142 and their respective recesses forming the keyholes 143 thus extending the whole length of, respectively, the beams 130 and arms 104, the beams 130 and, up to a certain extent, the arms 104 themselves may be selectively cut to desired lengths so as to suit a particular application of the system 100. This aspect is an advantage over other known suspended ceiling system of the prior art, which generally do not allow this on site customization of lengths of the components due to the end connection arrangements of the latter's.

Figure 56:
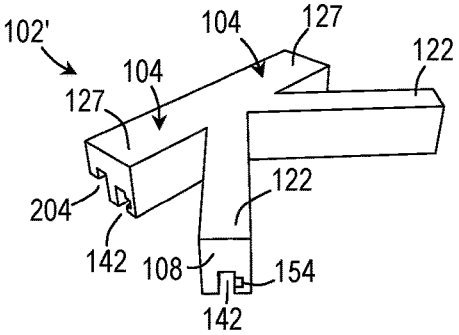
FIG. 56, in a perspective view, illustrates a connector that is usable as an alternative to the connector of FIG. 8.

Referring to FIG. 56, in some embodiments, each connector 102 is replaced by an alternative connector 102' including two arms 104 extending at 180 degrees opposed to each other, and two intermediate arms 122 having their respective proximal end 106 joined centrally along the inner longitudinal side surface 114 of the connector 102, at a junction of the two arms 104, perpendicularly with each other.

Figure 55:
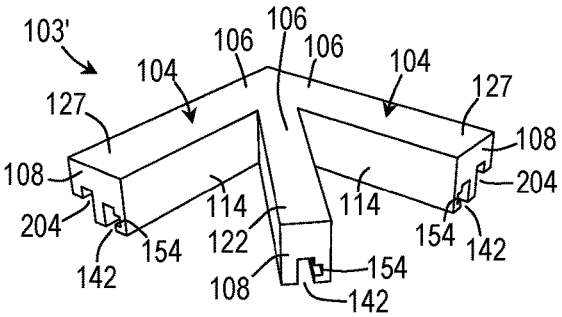
FIG. 55, in a perspective view, illustrates a connector that is usable as an alternative to the connector of FIG. 14.
Figure 57:
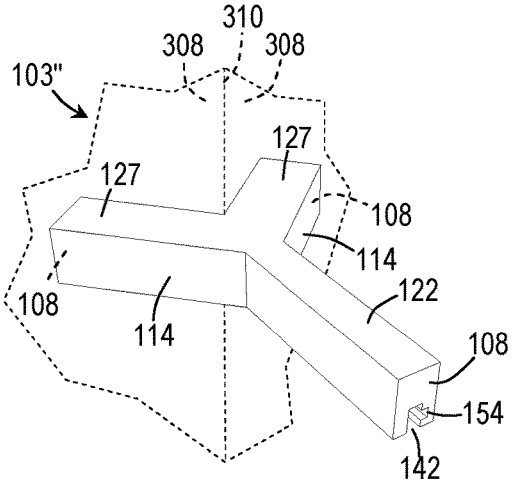
FIG. 57, in a perspective view, illustrates another connector that is usable as an alternative to the connector of FIG. 14.
Figure 58:
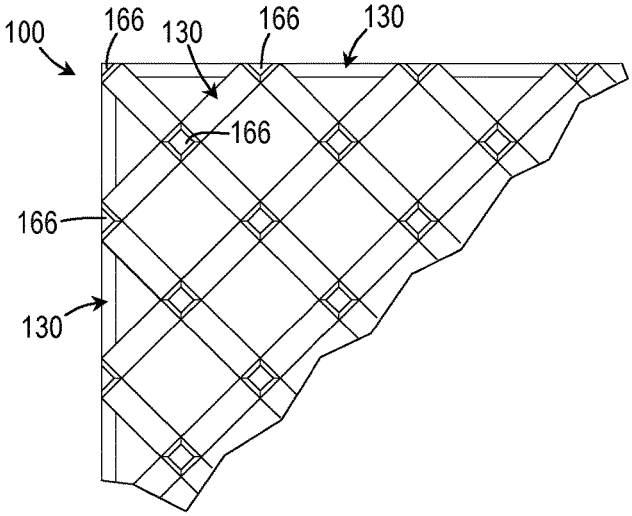
FIG. 58, in a bottom plan view, illustrates diamond-shaped aesthetical customization of the suspended ceiling system using the connectors of FIGS. 3, 55 and 56.

Furthermore, each connector 103 is replaced by a connector 103' having two arms 104 perpendicular to each other, and an intermediate arm 122 extending from a junction of the two arms 104 and bisecting these two arms 104. As seen in FIG. 55, the intermediate arm may be inside a corner defined by the two arms 104, or, as in the connector 103" shown in FIG. 57, may be outside of this corner. Thus, using the connectors 102, 103', 103" (if required) and 124, the assembled system 100 may define a diamond grid-like structure relative to the parallelly extending walls 304 of a square room.

Referring to FIGS. 1, 47, 48, 59 and 60, in some embodiments of the system 100, the system 100 further comprises an intermediate support 270 having an elongated configuration defining a lower end connected to a substantially centrally located upper side surface portion of user selected cross junction components 124, and an upper end connected to a stationary support structure 312 overlying the common plane of the system 100. Thus, the system 100 may be assembled to cover a substantially large common plane between widely spaced apart walls 304 of a room without bowing down due to the overall weight of the assembly.

Figure 59:
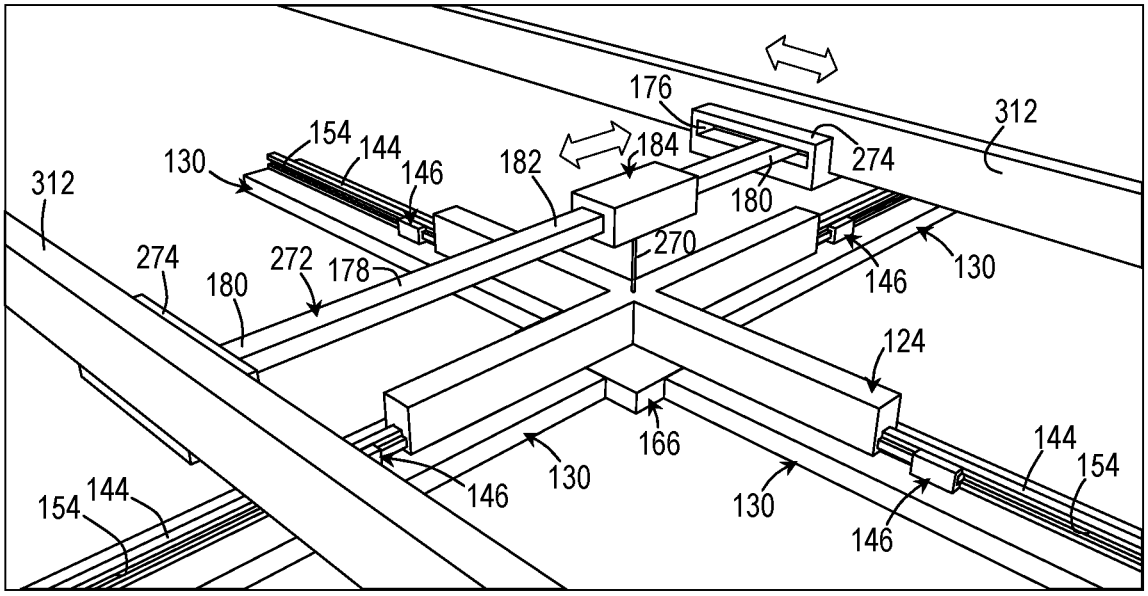
FIG. 59, in a perspective view, illustrates an adjustable suspension element part of some embodiments of the suspended ceiling system of FIG. 1.

Referring to FIG. 59, in some embodiments of the system 100, the system 100 further comprises an adjustable support component 272 for adjustably connecting the upper end of the intermediate support 270 between two spaced apart support structure members of the stationary support structure 312 overlaying the common plane of the system 100.

The adjustable support component 272 includes a pair of support brackets 274. Each support bracket 274 is connected to a respective one of the spaced apart support structure members and includes a slot 176 extending parallel to the common plane of the system 100 and is oppositely parallelly facing the slot 176 of the other support bracket 174 in the pair.

The adjustable support component 272 further includes an elongated member 178 having a pair of oppositely extending end portions 180 and an intermediate portion 182 extending therebetween. The elongated member 178 is suitably sized and shaped so as to have the end portions 180 thereof slidably engaged in a respective one of the oppositely facing slots 176 of the pair of support brackets 274. The adjustable support component 272 further includes a tubular member 184 slidably coaxially engaged along the intermediate portion 182 of the elongated member 178.

Thus, the intermediate support 270 may have its upper end adjustably connected to the overlaying stationary support structure 312 through the adjustable support component 272 having its pair of support brackets 274 connected between a pair of spaced apart support members of the stationary support structure 312.

Referring to FIGS. 13, 22 to 26, 46 and 50, in some embodiments of the system 100, the system 100 further comprises a wall mount arrangement 190 for removably engaging the connectors 102 with the flat wall surfaces 304 and wall corners 310 of the room.

The wall mount arrangement 190 includes a plurality of mounting brackets 192. Each mounting bracket 192 has a substantially elongated configuration defining a pair of spaced apart mounting bracket end portions 194 and a mounting bracket intermediate portion 196 extending therebetween.

Each mounting bracket 192 further defines front and rear longitudinal side surfaces 198 and 200 extending substantially the whole length thereof. The rear longitudinal surface 200 is adapted for longitudinal attachment in an end to end configuration along the walls and corners surfaces of the room and substantially in register with the common plane of the system 100 so as to surround the room along the flat walls 304 and wall corners 310 thereof.

Each mounting bracket 192 further defines a lip 202 extending longitudinally and substantially upwardly from the front longitudinal surface 198, and in a parallelly spaced apart relationship relative to the rear longitudinal surface 200 respectively, protruding from a top surface 197 of the mounting bracket 192. The portion of the mounting bracket 192 below the lip 202 is configured for mounting to the wall 304. The lip 202 and top surface 197 are configured for supporting the connectors 102 and 103. To that effect, referring more particularly to FIGS. 8, 9, 20, 21 and 26, the wall mount arrangement 190 further includes a lip engaging recess 204 extending longitudinally and at least partially upwardly inwardly relative to the underside surface 120 of each connector 102 and 103, and parallelly proximally the longitudinal outer side surface 116 thereof. The lip engaging recess 204 is shaped and sized for removably engaging, in a snug fit relation, the lip 202 of the mounting bracket 192 such that the longitudinal underside surface 120 of the connector 102 is located substantially in register with a longitudinal underside edge 206 of the mounting bracket 192, as best illustrated in FIG. 26.

Thus, the plurality of mounting brackets 192 may be first relatively easily attached linearly in register with the common plane of the system 100 along the wall and corner surfaces of the room using nails and a hammer, or a nail stapler, followed with engaging the plurality of connectors 102 at user selected positions along the lip 202 of the mounting brackets 192.

Figure 62:
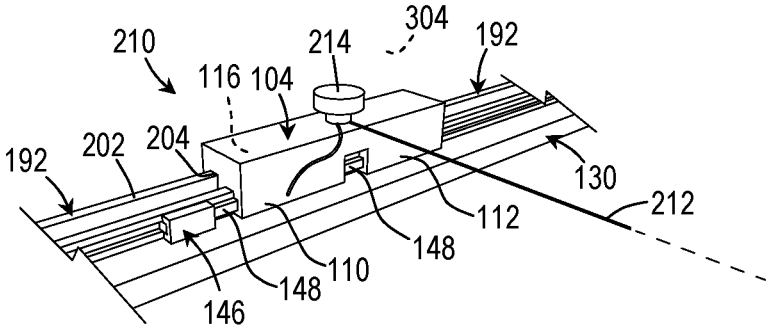
FIG. 62, in a perspective view, illustrates a guide tool slidably engaged to mounting brackets and usable to selectively align components of the suspended ceiling system of FIG. 1 during its assembly.

Referring to FIG. 62, in some embodiments of the system 100, the system 100 further comprises one or more guide tools 210.

The one or more guide tools 210 each include a first arm 110 and a second arm 112 joined to one another through their respective proximal end 106, with each arm extending distally therefrom in the common plane of the system 100 and at a predetermined angle relative to one another with respect to an outer longitudinal side surface 116 of the guide tool 210 extending along both the first and second arms 110 and 112 respectively.

The predetermined angle for the guide tool 210 being one of 180 degree, positive 90 degree, or negative 90 degree, depending on the location of engagement of the guide tool 210 along the plurality of mounting brackets 192 attached to the walls 304 (e.g. a flat wall surface, a negative wall corner or a positive wall corner respectively).

Furthermore, the guide tool 210 defines a longitudinal underside surface 120 extending along the longitudinal underside of both the first and second arms 110 and 112, and a lip engaging recess 204 extending there along and proximally parallelly the longitudinal underside surface 120 of the guide tool 210.

Thus, the one or more guide tools 210 are usable, in cooperation with mounting brackets 192 attached along selected wall surfaces 304 of the room, a cord 212 removably attached to a centered portion of the guide tool 210 through a hand knob 214, or the like, and a common level tool, for assisting a user to relatively easily align the attachment of the plurality of mounting brackets 192 along all the walls of the room in a true horizontal common plane.

The guide tool 210 may further be useful for assisting a user to rectilinearly align alternating longitudinal assemblies of beams 130 and connectors 124 extending between two connectors 102 or 103 mounted along oppositely facing walls 304, two adjacent walls 304, or wall corners 310 of the room.

The various structural components of the suspended ceiling system 100 may be sized to substantially any reasonable scale for a given application. For example, and non-limitingly, typical dimensions for the connector 102 may measure about 6" by 6" in the common plane, and about 1.25" in height, while the connector 124 may measure about 15.5" in the common plane and 1.25" in height. The typical dimensions of the other structural components such as the beams 130 and drop-in panels 162 may vary quite substantially, depending on the desired size and proportions of the aesthetical aspect of the resulting grid-like structure visible by a person standing in the room.

The various components of the suspended ceiling system 100 can be made of any suitably rigid material or combination of materials such as, for example, wood, a suitably rigid plastic using an appropriate injection or extrusion manufacturing process, and metal sheets using any known punch press process.

In some embodiments, at least the various structural components may be entirely made of wood. Advantageously, as illustrated in FIGS. 40 to 44, all the structural components of the customizable suspended ceiling system 100, such as the connectors 102, 103 and 124 beams 130, connector-to-beam junctions 140 and wall mount arrangements 190, including the locking key 146, may be entirely made out of an assembly of recycled woodwork leftovers having a same thickness. For example, as exemplified in the figures, 0.292" thick wooden sticks, or baguettes, may be stacked side-by-side using glue, wood staples or the likes. Thus a large part of the system 100 may be economically manufactured, as well as representing an environmentally conscious product.

Further advantageously, the suspended ceiling system 100 of the present invention, as described above, can be easily mounted, and eventually as easily disassembled if desired, using only a relatively small number of the most basic carpenter tools such as a hammer, nails, a hand saw and a level tool. Of course, gains in assembly time may be achieved using a power nail stapler, a power miter saw and a small laser level tool.

Further advantageously, in some embodiments, the customizable suspended ceiling system 100 of the present invention may be assembled by a user having little or no experience in the assembly of suspended ceilings. Indeed, the use of locking keys 146 for assembling the grid-like structure means that, advantageously, over 90% of the assembly work of the system 100 does not need tools at all.

Further advantageously, the customizable suspended ceiling system 100 allows a user to relatively easily customize the latter between a relatively simple ornamental molding pattern, and a highly complex design pattern visible along the surface of the suspended ceiling system 100 using a relatively small basic set of modular components thereof.

Further advantageously, the high modularity of the suspended ceiling system 100 allows a user to modify the design pattern as the suspended ceiling is progressively assembled such as, for example, across two large sections of a same room.

Further advantageously, a set of ready to install components for mounting and assembling the customizable suspended ceiling system 100 in a room of a given size may be all packaged in a single box having sides no greater than the area of one of the drop-in panels of the system, since the drop-in panels have the greatest dimension of the components. Thus, the customizable suspended ceiling system 100 may be advantageously sold on-line and delivered via parcel shipping to customers.

Figure 61:
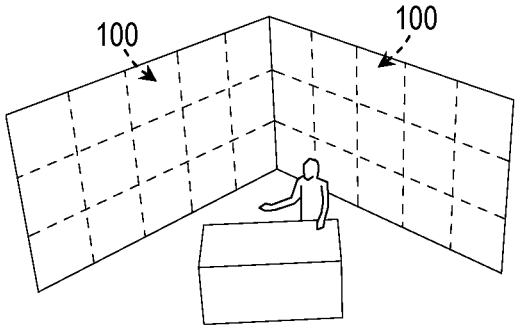

Further advantageously, as illustrated in FIG. 61, an assembled grid-like structure of the system 100, but without wall mount arrangements 190, may be used as a collapsible and easily portable temporary wall partition. In the figure, two such grid-like structures of the system 100 are disposed vertically and joined to one another along adjacent vertical side edges thereof in a self-standing V-shaped configuration that can be used as a backdrop structure for supporting marketing canvas behind a trade show boot or the like.

Figure 53:
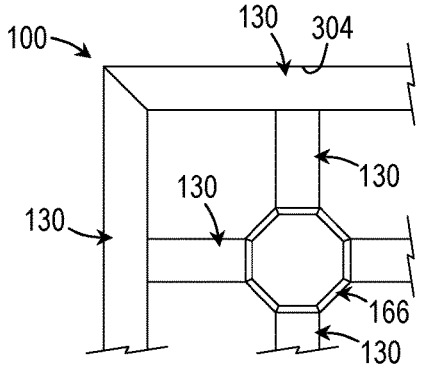
FIG. 53, in a bottom plan view, illustrates a configuration of the suspended ceiling system of FIG. 1 in which a third aesthetic aspect is achieved.
Figure 54:
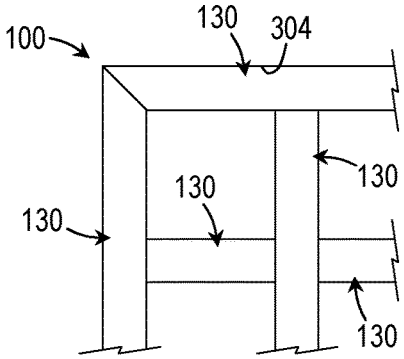
FIG. 54, in a bottom plan view, illustrates a configuration of the suspended ceiling system of FIG. 1 in which a fourth aesthetic aspect is achieved.

Although there is illustrated in the figures mainly square-shaped decorative elements 166, as in FIGS. 1, 30, 32 and 58, it is to be understood that all or selected decorative elements 166 of the system 100 may have other shape configurations such as, non limitatively, rounded, rectangular, hexagonal, as exemplified in FIG. 53, octagonal, and the likes. Or the user may chose to have a system 100 without any decorative elements 166 at all, as exemplified in FIG. 54.

Although the present invention has been described hereinabove by way of exemplary embodiments thereof, it will be readily appreciated that many modifications are possible in the exemplary embodiments without materially departing from the novel teachings and advantages of this invention. Accordingly, the scope of the claims should not be limited by the exemplary embodiments, but should be given the broadest interpretation consistent with the description as a whole. The present invention can thus be modified without departing from the spirit and nature of the subject invention as defined in the appended claims.

What is claimed is:

1. A suspended ceiling system for suspending panels, comprising:

a plurality of elongated beams each defining a beam longitudinal axis, each of the beams defining longitudinally opposed beam end sections;

a plurality of connectors for connecting the beams to each other to form a panel support structure for supporting the panels, each of the connectors defining at least two spaced apart beam coupling sections for each coupling to a respective one of the beams through one of the beam end sections; and a plurality of locking keys for selectively locking the connectors and beams to each other;

wherein, with the suspended ceiling system assembled, the beams are joined to each other by the connectors to form a grid configured for supporting the panels, the beams and connectors forming connector-to-beam junctions each including one of the beam end sections and one of the beam coupling sections engaging each other and together defining a keyhole, the keyhole including keyhole beam and connector portions defined respectively by the one of the beam end and coupling sections, the keyhole receiving thereinto one of the locking keys so that movements of the one of the beam end section and the one of the beam coupling section relative to each other perpendicularly to the keyhole are prevented to secure the one of the beam end sections and the one of the beam coupling sections to each other;

the suspended ceiling system further comprising decorative elements supported in register with the connectors to hide the connectors from below, the decorative elements each defining a decorative element keyhole portion positioned in prolongation of the keyhole beam portions so that a single locking key locks both one of the beams and the decorative element to the connector when the suspended ceiling system is assembled.

2. The suspended ceiling system as defined in claim 1, wherein the keyhole is elongated and extends substantially parallel to the beam longitudinal axis.

3. The suspended ceiling system as defined in claim 1, wherein each connector-to-beam junction is configured and sized to allow relative movements between the beam end section and the beam coupling section perpendicularly to the beam longitudinal axis when the locking key is removed from the keyhole.

4. The suspended ceiling system as defined in claim 1, wherein the locking key is slidable toollessly in the keyhole.

5. The suspended ceiling system as defined in claim 1, wherein the locking key includes a substantially elongated key body of substantially constant transversal cross-sectional configuration therealong.

6. The suspended ceiling system as defined in claim 5, wherein the locking key further includes a handling portion extending from the key body and protruding laterally relative thereto.

7. The suspended ceiling system as defined in claim 1, wherein the beam coupling section defines a longitudinal coupling section groove extending thereinto, the keyhole connector portion extending from the coupling section groove laterally relative thereto into the beam coupling section; and the beam end section defines a protrusion inserted in the coupling section groove when the beam coupling section and the beam end section are joined to each other, the keyhole beam portion extending in the protrusion laterally relative thereto so that when the beam coupling section and the beam end section are joined to each other, the keyhole beam and coupling portions face each other to together define the keyhole.

8. The suspended ceiling system as defined in claim 7, wherein the protrusion extends substantially along the entirety of the beam and wherein opposed keyhole beam portions provided in each beam end section are joined to each other through a keyhole groove so that the keyhole groove and keyhole beam portions together defines a longitudinal groove of substantially constant transversal cross-sectional configuration therealong extending along the entirety of the protrusion.

9. The suspended ceiling system as defined in claim 7, wherein at least some of the beams each define a pair of panel support flanges laterally protruding from the protrusion opposed to each other so that the at least some of the beams each have a generally T-shaped cross-sectional configuration.

10. The suspended ceiling system as defined in claim 1, wherein the plurality of connectors includes T-shaped edge connectors having three edge arms each provided with a respective one of the beam coupling sections, L-shaped corner connectors having two corner arms each provided with a respective a respective one of the beam coupling sections and X-shaped middle connectors having four middle arms each provided with a respective one of the beam coupling sections, wherein, when the suspended ceiling system is assembled, the edge connectors and corner connectors are provided at a periphery of the suspended ceiling system and the middle connectors are provided inside the periphery of the suspended ceiling system.

11. The suspended ceiling system as defined in claim 10, further comprising a plurality of mounting brackets mountable to a wall, each mounting bracket including a wall mount mountable to the wall and a connector support extending therefrom, the connector support being configured for supporting thereonto the edge and corner connectors.

12. The suspended ceiling system as defined in claim 11, wherein the connector support includes a support top surface facing upwardly when the connector support is operatively mounted to the wall and a connector protrusion protruding from the support top surface, and wherein the corner and edge connectors each define a mounting groove extending therealong for receiving the connector protrusion when supported by the mounting bracket.

13. The suspended ceiling system as defined in claim 11, further comprising a guide tool including a body configured for engaging the mounting brackets and a wire extending therefrom for indicating an horizontal direction along which the system is to be assembled.

14. The suspended ceiling system as defined in claim 10, wherein at least some of the middle connectors are provided with a support extending upwardly therefrom or securing the at least some of the middle connectors to an overhanging structure.

15. The suspended ceiling system as defined in claim 1, wherein the plurality of connectors includes edge connectors having four edge connector arms each provided with a respective one of the beam coupling sections, two of the edge connector arms being colinear, with remaining edge connector arms forming a V-shape and extending from the two of the edge connector arms, corner connectors having three corner arms each provided with a respective one of the beam coupling sections, two of the corner arms being perpendicular to each other and being bisected by the remaining corner arm and X-shaped middle connectors having four middle arms each provided with a respective one of the beam coupling sections, wherein, when the suspended ceiling system is assembled, the edge connectors and corner connectors are provided at a periphery of the suspended ceiling system and the middle connectors are provided inside the periphery of the suspended ceiling system.

16. The suspended ceiling system as defined in claim 1, wherein the connectors and beams are all made of wood.

17. A suspended ceiling mounted in a room, comprising the suspended ceiling system according to claim 1 in an assembled configuration in which the grid is defined, and panels supported by the suspension system to fill empty spaces defined by the grid.

18. A suspended ceiling system for suspending panels, comprising:

a plurality of elongated beams each defining a beam longitudinal axis, each of the beams defining longitudinally opposed beam end sections;

a plurality of connectors for connecting the beams to each other to form a panel support structure for supporting the panels, each of the connectors defining at least two spaced apart beam coupling sections for each coupling to a respective one of the beams through one of the beam end sections; and a plurality of locking keys for selectively locking the connectors and beams to each other;

wherein the connectors and beams are all made of wood; and wherein, with the suspended ceiling system assembled, the beams are joined to each other by the connectors to form a grid configured for supporting the panels, the beams and connectors forming connector-to-beam junctions each including one of the beam end sections and one of the beam coupling sections engaging each other and together defining a keyhole, the keyhole including keyhole beam and connector portions defined respectively by the one of the beam end and coupling sections, the keyhole receiving thereinto one of the locking keys so that movements of the one of the beam end section and the one of the beam coupling section relative to each other perpendicularly to the keyhole are prevented to secure the one of the beam end sections and the one of the beam coupling sections to each other.

* * * * *